US007104723B2

(12) United States Patent
Holmes

(10) Patent No.: US 7,104,723 B2
(45) Date of Patent: Sep. 12, 2006

(54) SCREEDING APPARATUS AND METHOD

(76) Inventor: Ned W. Holmes, 1915 Rancho Andrew, Alpine, CA (US) 91901

( * ) Notice: Subject to any disclaimer, the term of this patent is extended or adjusted under 35 U.S.C. 154(b) by 0 days.

(21) Appl. No.: 11/068,669

(22) Filed: Feb. 28, 2005

(65) Prior Publication Data

US 2005/0141963 A1 Jun. 30, 2005

Related U.S. Application Data

(63) Continuation-in-part of application No. 10/612,360, filed on Jul. 1, 2003, now abandoned.

(51) Int. Cl.

| | |
|---|---|
| ***E01C 7/00*** | (2006.01) |
| ***E01C 19/00*** | (2006.01) |
| *E01C 7/20* | (2006.01) |
| *E01C 7/22* | (2006.01) |

(52) U.S. Cl. ..... 404/75; 404/92; 404/101; 404/102

(58) Field of Classification Search ..... 404/75, 404/92, 101, 102, 96

See application file for complete search history.

(56) References Cited

U.S. PATENT DOCUMENTS

| | | | | |
|---|---|---|---|---|
| 3,972,666 | A * | 8/1976 | Pandur | 425/208 |
| 4,078,621 | A * | 3/1978 | Dewar et al. | 175/394 |
| 4,350,657 | A * | 9/1982 | Jones et al. | 264/349 |
| 4,380,533 | A * | 4/1983 | Wojtowicz | 423/473 |
| 4,601,629 | A | 7/1986 | Zimmerman | |
| 4,930,935 | A | 6/1990 | Quenzi et al. | |
| 4,949,795 | A * | 8/1990 | McDonald et al. | 175/40 |
| 5,599,098 | A | 2/1997 | Christie | |
| 5,865,592 | A * | 2/1999 | Hansen | 414/502 |

* cited by examiner

*Primary Examiner*—Raymond W Addie
(74) *Attorney, Agent, or Firm*—Gene Scott; Patent Law & Venture Group

(57) ABSTRACT

A screed assembly apparatus for loose or plastic materials such as placed and/or poured, uncured concrete previously placed on the ground or another support surface, includes a screed frame, and mounted thereon, a striker for engaging and spreading the materials and a rotatable auger for moving the material longitudinally along the screed frame. The auger provides a pair of intertwined spiral flight coils. The striker is spaced to one side of the auger and in parallel thereto. An auger mounting means and a motive power means are engaged for rotating the auger to remove excess portions of the concrete from the pour.

7 Claims, 6 Drawing Sheets

SCREEDING APPARATUS AND METHOD

RELATED APPLICATIONS

This application is a Continuation-In-Part application of prior filed non-provisional application Ser. No. 10/612,360 filed on Jul. 1, 2003 now abandoned and entitled Screeding Apparatus and Method, and is filed during the pending period thereof.

INCORPORATION BY REFERENCE

Applicant(s) hereby incorporate herein by reference, any and all U.S. patents, U.S. patent applications, and other documents and printed matter cited or referred to in this application.

1. Field of the Invention

This invention relates generally to concrete pad finishing machinery and more particularly to a surface finishing machine of the type providing a pull-off auger for reduction of the volume of concrete laying in a pour.

2. Description of Related Art

The prior art teaches the use of screeding apparatus and methods, see the Quenzi et al reference, U.S. Pat. No. 4,930,935, but does not teach such using an auger with double intertwined spiral flight coils within a range of conformation described herein as applied to leveling and smoothing a newly poured concrete pad or similar construction. The present invention fulfills these needs and provides further related advantages as described in the following summary.

SUMMARY OF THE INVENTION

The present invention teaches certain benefits in construction and use which give rise to the objectives described below.

A screed assembly apparatus for loose or plastic materials such as placed and/or poured, uncured concrete previously placed on the ground or another support surface, includes a screed frame, and mounted thereon, a striker for engaging and spreading the materials and a rotatable auger for moving the material longitudinally along the screed frame. The auger provides a pair of intertwined spiral flight coils. The striker is spaced to one side of the auger and in parallel thereto. An auger mounting means and a motive power means are engaged for rotating the auger to remove excess portions of the concrete from the pour. By using dual flight coils, contact with the concrete is doubled during the leveling process which provides significant improvement of the speed with which excess concrete may be removed and also improving flatness. Each revolution of the auger moves twice the volume of concrete of a single flight auger and leaves the surface of the concrete twice as smooth. This is an unexpected result of great importance. No double flight augers of the type described herein are in use in the present application in the United States, territories or possessions to your applicant's knowledge, although single flight augers have been used in the present application since at least 1990.

A primary objective of the present invention is to provide an apparatus and method of use of such apparatus that provides advantages not taught by the prior art.

Another objective is to provide such an invention capable of improved efficiency in removal of excess material from an uncured concrete pad, which allows significantly faster screeding.

A further objective is to provide such an invention capable of improving the surface finish of an uncured concrete pad.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
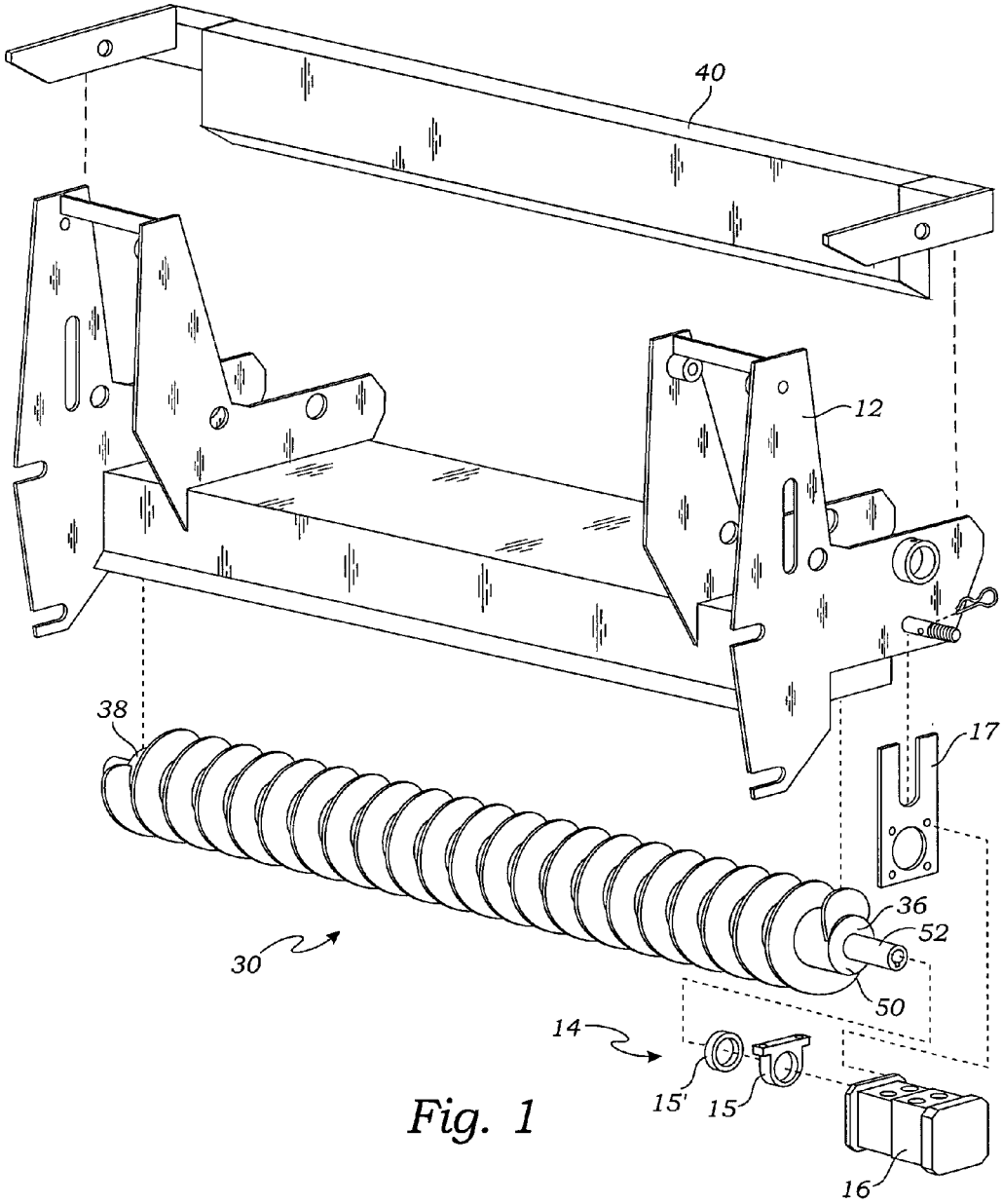
FIG. 1 is a perspective exploded view of the preferred embodiment of the invention.
Figure 2:
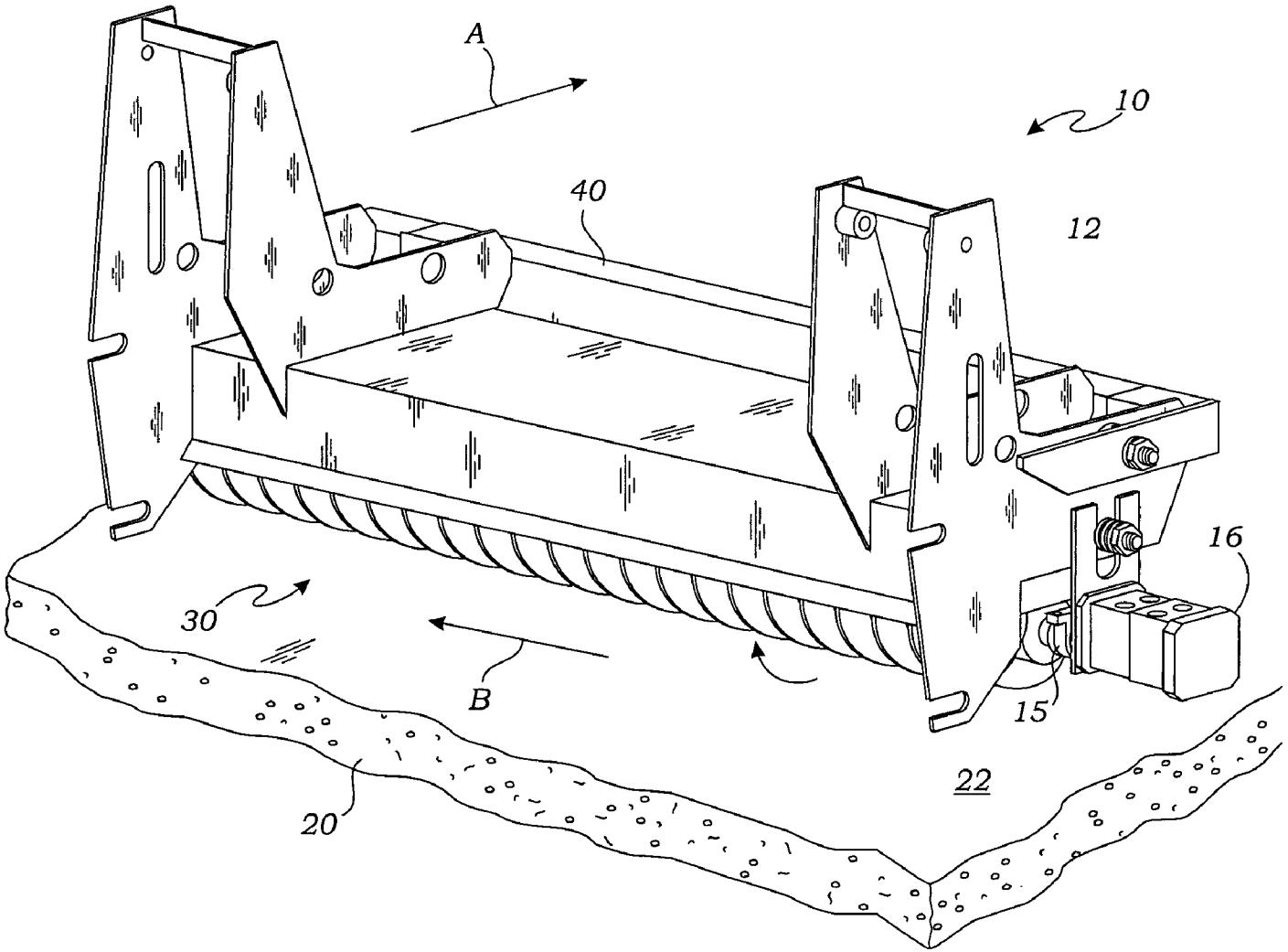
FIG. 2 is a perspective view thereof as assembled.
Figure 3:
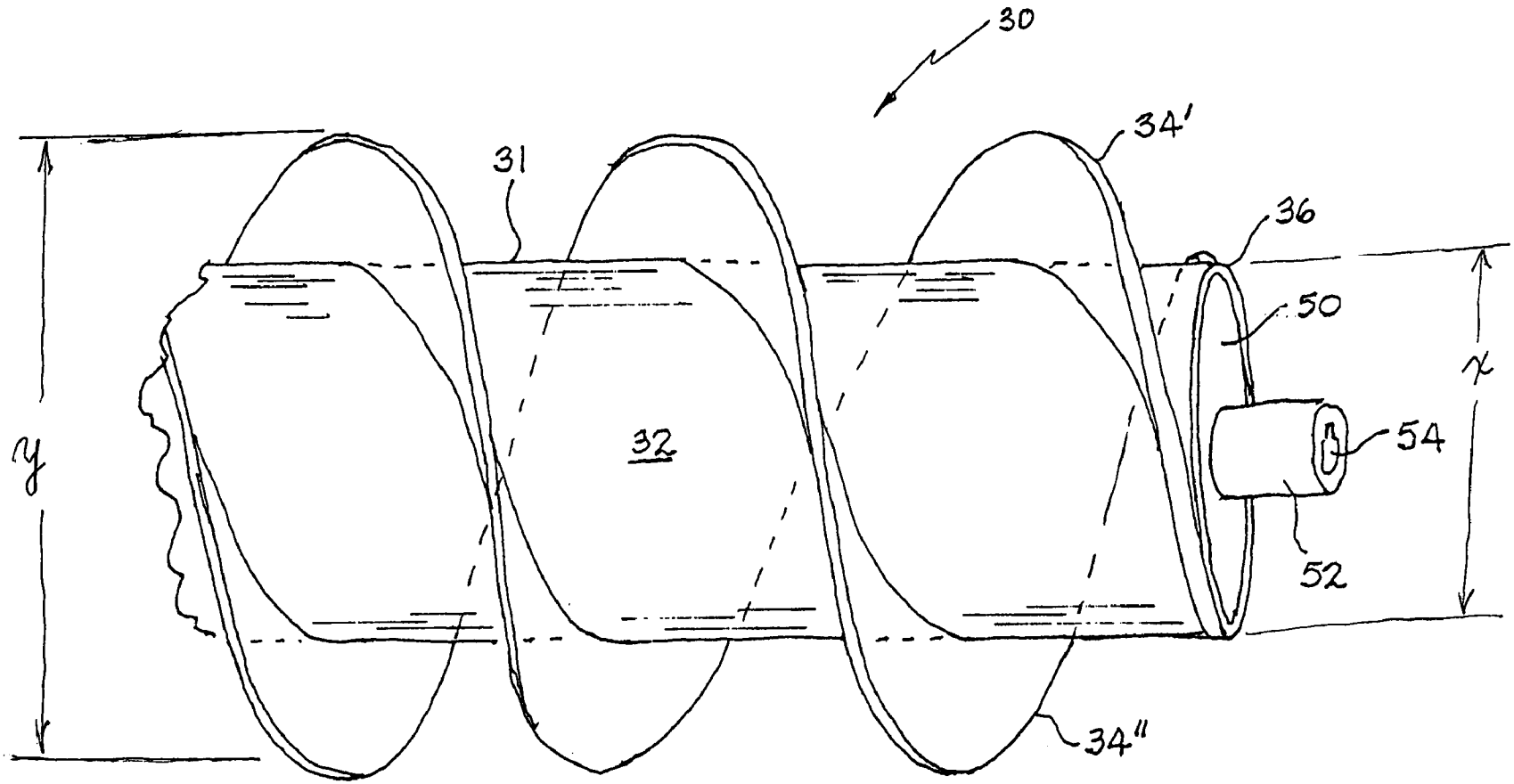
FIG. 3 is a partial perspective view of a dual intertwined spiral auger thereof, defining one end thereof, the opposing end being identical thereto.
Figure 4:
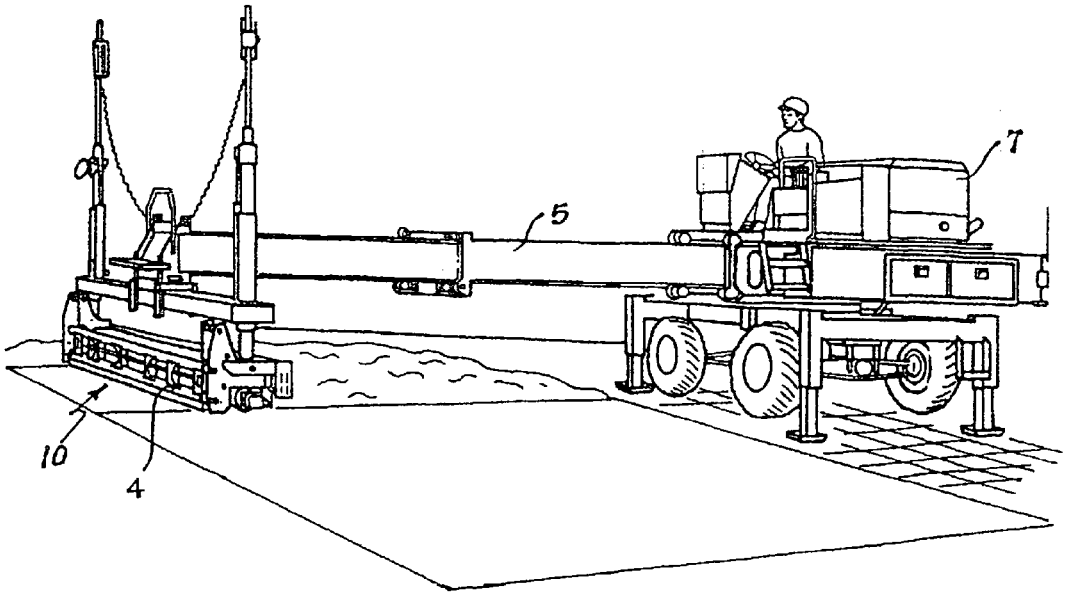
FIG. 4 is a perspective view of the preferred embodiment as used in the art of concrete leveling.

The present invention is a screed assembly apparatus 10 and method of its use for removing excess portions of a loose or plastic material such as is commonly placed and/or poured, as for instance, uncured concrete 20 poured on a support surface such as bare earth. The use of such a device is well known, as described in U.S. Pat. No. 4,930,935 to Quenzi et al, but what is not known, is the use of a dual intertwined spiral auger 30 of a particular size for such purposes. The apparatus comprises a screed frame 12, as best shown in FIG. 1. Mounted on the screed frame 12 is a striker 40 for engaging and spreading the concrete 20, and the rotatable auger 30 for moving the concrete 20 longitudinally along the screed frame 12. The auger 30 has an auger core or base cylinder 31 of between 2 and 10 inches in diameter and a length, typically, of between 8 and 12 feet, with a pair of intertwined spiral flight coils 34', 34" (FIG. 3) of typically ¼ inch coil steel and having a preferred height of about 1-⅞ inches, but which also may be between 1 and 5 inches, and a spacing of between 3 and 5 inches and welded onto its outer surface 32, as best seen in FIG. 3. Therefore, the auger core 31 has an outside diameter "x" of between 2 and 10 inches, and the outside diameter of the coils is between 4 and 12 inches as defined by dimension "y" in FIG. 3. It has been found that auger core and flight sizes outside of the above ranges do not meet the objectives of the present invention and do not provide significant benefit. The auger of this invention is preferably made of steel. The screed frame 12 provides an auger mounting means 14, preferably pillow block 15, spacer 15' and end blocks 50, described below. The screed frame 12 also provides a motive power means 16, preferably an electric or hydraulic motor, engaged with the end blocks 50 for rotating the auger 30. The motor 16 is mounted to plate 17, which is in turn mounted to frame 12 in such a manner as to enable the drive shaft (not visible) of motor 16 to engage the auger 30 at the end blocks 16. Both ends 36, 38 of the auger 30 are mounted to frame 12 in the same manner and with the same hardware. Details of this enablement are defined further in the Quenzi et al reference U.S. Pat. No. 4,930,935. Not shown in the figures is that the screed assembly apparatus 10 is mounted on a boom 5 of a mobile screeding machine 7 shown in FIG. 4 and as fully described in the Quenzi et al reference, which enables screed assembly apparatus 10 to be moved vertically to partially immerse the striker 40 and the auger 30, within the concrete 20 and further enables the screed assembly apparatus 10 to be moved through and across the concrete 20. The striker 40 is spaced to one side of the auger 30 as is well shown in FIG. 2, and is mounted in parallel thereto. As the screed assembly apparatus 10 moves in the direction of arrow "A" in FIG. 2, the striker 40 acts as a doctoring blade which tends to level the surface of the concrete 20. The auger 30 follows the striker 40 as the screed frame 12 moves across the concrete 20 the auger 30 rotating to draw, or pull-out excess amounts of the concrete 20 and small stones or rocks therein, so as to place the concrete surface 22 at a desired smoothness and levelness. The direction of concrete pull-out is shown by arrow "B" and may be reversed by rotating the auger in the opposing sense. Frame 12 also may mount a vibratory compaction device 4 shown in FIG. 4, and well defined in the Quenzi et al reference. The know-how for preparing augers for the present application is well known, so that it is not necessary to teach the method of fabrication of a dual flight coil auger as it maybe easily be extrapolated from the techniques of fabrication of a single flight coil auger.

As shown in FIG. 3, the screeding auger 30 comprises a auger core or cylindrical body 31 supporting on the outer surface 32 thereof, the dual intertwined spiral flight coils 34', 34" are continuous and extensive between ends 36, 38 of the cylindrical body 31, as best seen in FIGS. 1 and 3. The flight coils 34', 34" are preferably welded onto surface 32. A pair of end blocks 50 are fixed, preferably by welding them in place, in the ends 36, 38 of the cylindrical body 31. The end blocks 50 provide longitudinally extensive opposing rods 52 having means for keyed engagement 54 therein, preferably a Woodruff key slot. The motor 16 has a drive shaft, not visible in the figures, and the drive shaft is keyed to fit into the rods 52, as is well known in the art for mechanical motion drives.

The screeding method of the present invention includes mounting the striker 40 and the: rotatable cylindrical body 31 in parallel on the screed frame 12, intertwining the dual spiral flight coils 34', 34" on the outside surface 32 of the cylinder 31 between ends 36, 38 of the cylinder 31; positioning the striker 40 spaced to one side of the auger 30 and in parallel thereto; positioning the auger 30 partially immersed in the uncured concrete 20; and rotating the auger 30 for removal of an excess portion of the concrete 20 while drawing the auger 30 and the striker 40 in a lateral direction "A".

The method further includes the steps of fixing the pair of end blocks 50 in the cylindrical body 31, the extending opposing rods 52 from the end blocks 50 longitudinally, and engaging one of the keyed apertures 54 in one of the opposing rods 52 with the motive means 16 for rotating the auger 30.

Figure 5:
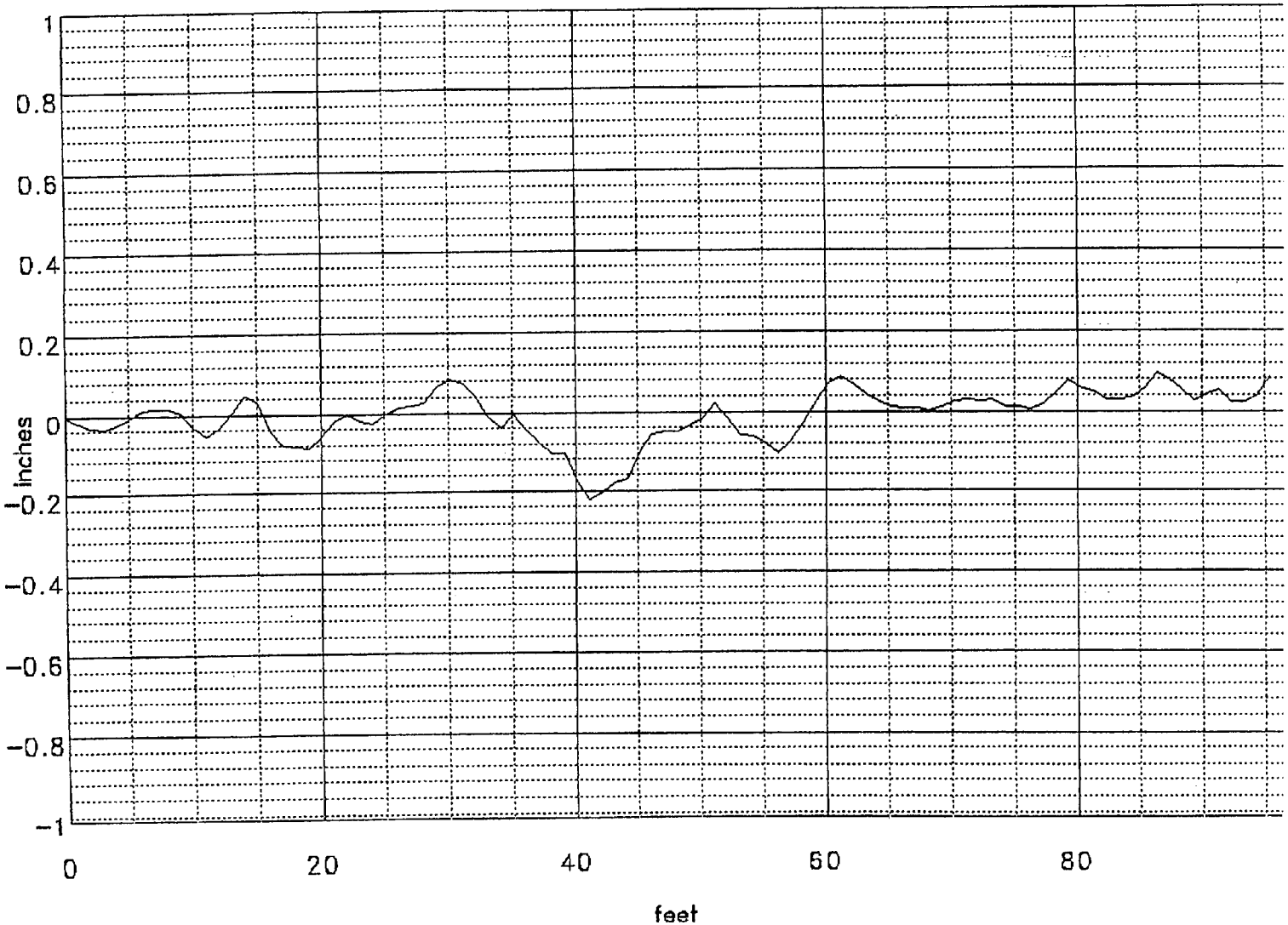
FIG. 5 is a graphical representation of the surface finish results using a single coil auger known in the art.
Figure 6:
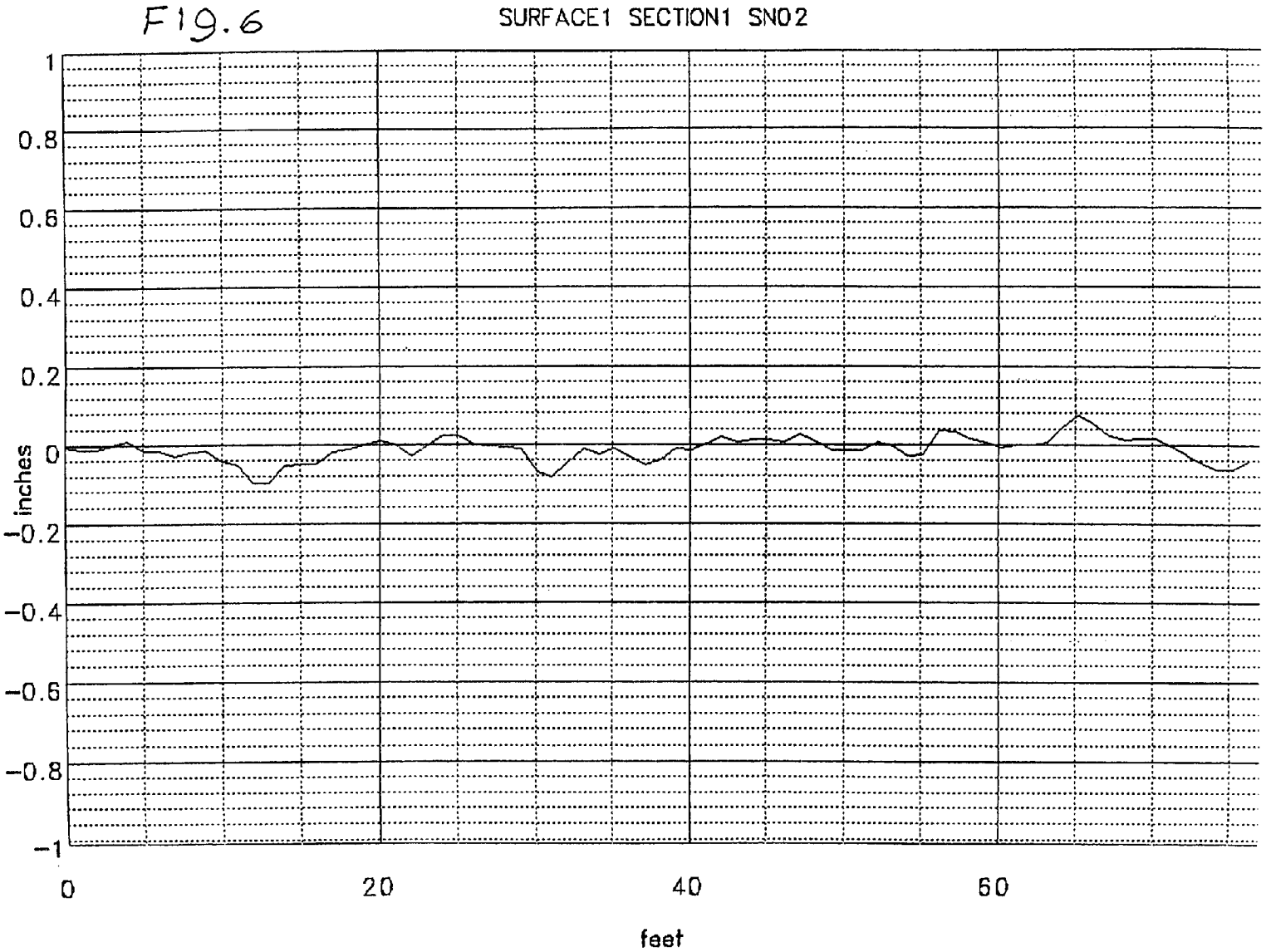
FIG. 6 is a similar graphical representation of the surface finish results using a dual coil auger of the present invention.

In tests of the present invention using the method of the present invention and applying standard practice techniques have shown significant improvements in the art. FIG. 5 is a graph of surface finish of a concrete pad finished using a single coil auger as is well known in the art and taught by Quenzi et al. The ordinate axis defines surface roughness while the abscissa axis defines the distance of measurement across the concrete pad that the auger has traveled. It is noted that FIG. 5 shows a surface roughness of about 0.30 maximum peak-to-peak inches. FIG. 6 is an identical measurement and presentation of a concrete pad finished using the double coil auger of the present invention. It is noted that the surfaced finish here is about 0.18 maximum peak-to-peak inches, a reduction of about 40%, i.e., the surface is almost twice as smooth using the double coiled auger. Additionally, the amount of excess concrete 20 that is able to be removed per unit time from the poured pad is approximately double that of a standard single coil auger operated at the same rotational speed. It is further noted, that the rotational speed of both the single and double coiled augers in these tests were identical.

It is noted here that in reference units used in the industry by those of skill in the art, over the last 50 years surface smoothness has moved from 5 or 10 units of smoothness into the range of about 50 units of smoothness, and this primarily due to the machine taught by Quenzi et al. Now, with the double flight auger with size and proportions defined above, we have moved into the range of 100 units of smoothness, at least a doubling in the range of smoothness.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An apparatus for smoothing a surface of poured concrete, said apparatus comprising: a screed frame, and mounted thereon, a striker for engaging and spreading the poured concrete, and a rotatable auger, for moving the concrete longitudinally along the screed frame, the auger providing a pair of intertwined spiral flight coils extending outwardly from an auger core, the coils continuous between a first and a second ends of the auger core, the flight coils having a height of between 1 and 5 inches; the striker spaced to one side of the auger and in parallel thereto, whereby the apparatus is enabled for producing a smoother poured concrete surface than an auger core having a single spiral flight.

2. The apparatus of claim 1 wherein the flight coils have an overall outside diameter between 4 and 12 inches.

3. The apparatus of claim 1 wherein the flight coils are approximately 1⅞ inches in height.

4. The apparatus of claim 1 wherein the auger core diameter is approximately 5.5 inches in diameter.

5. The apparatus of claim 1 wherein the flights of the auger core are spaced approximately 4.5 inches apart.

6. A method for smoothing a surface of poured concrete, said method comprising the steps of: mounting a striker and a rotatable auger core onto an operating screed frame, the striker and the auger core placed in side-by-side parallel positions; engaging a pair of intertwined spiral flight coils of between 1 and 5 inches in height onto the auger core continuously between a first and a second ends of the auger core; partially immersing the auger core within the poured concrete; and rotating the auger core and spiral flight coils while drawing the auger core and the striker in a lateral direction, thereby removing an excess portion of the poured concrete, whereby the surface of the poured concrete is smoother than is possible when the auger core has but one spiral flight.

7. A method for smoothing a surface of poured concrete, said method comprising the steps of: mounting a striker and a rotatable auger core onto an operating screed frame, the striker and the auger core placed in side-by-side parallel positions; engaging a pair of intertwined spiral flight coils of between 4 and 12 inches in outside diameter onto the auger core continuously between a first and a second ends of the auger core: partially immersing the auger core within the poured concrete; and rotating the auger core and spiral flight coils while drawing the auger core and the striker in a lateral direction, thereby removing an excess portion of the poured concrete, whereby the surface of the poured concrete is smoother than is possible when the auger core has but one spiral flight.

* * * * *